US009314664B2

(12) United States Patent
Villaume

(10) Patent No.: US 9,314,664 B2
(45) Date of Patent: Apr. 19, 2016

(54) BICYCLE SEAT AND HANDLEBAR MECHANISMS

(71) Applicant: Edward Villaume, Minneapolis, MN (US)

(72) Inventor: Edward Villaume, Minneapolis, MN (US)

( * ) Notice: Subject to any disclaimer, the term of this patent is extended or adjusted under 35 U.S.C. 154(b) by 0 days.

(21) Appl. No.: 14/094,705

(22) Filed: Dec. 2, 2013

(65) Prior Publication Data

US 2014/0150578 A1 Jun. 5, 2014

Related U.S. Application Data

(60) Provisional application No. 61/732,000, filed on Nov. 30, 2012, provisional application No. 61/756,414, filed on Jan. 24, 2013, provisional application No. 61/763,476, filed on Feb. 12, 2013.

(51) Int. Cl.

| | |
|---|---|
| ***A63B 22/06*** | (2006.01) |
| ***A63B 69/16*** | (2006.01) |
| ***A63B 22/12*** | (2006.01) |
| ***A63B 22/00*** | (2006.01) |

(52) U.S. Cl.

CPC ..... *A63B 22/0605* (2013.01); *A63B 22/0046* (2013.01); *A63B 2022/0652* (2013.01); *A63B 2225/09* (2013.01); *A63B 2225/093* (2013.01); *Y10T 74/18568* (2015.01)

(58) Field of Classification Search

CPC ..... A63B 2225/09; A63B 2225/093; A63B 21/008; A63B 21/0083; A63B 21/0087; A63B 2022/0082; A63B 21/0081; A63B 21/158; A63B 2225/096; A63B 21/0085; A63B 22/0046; A63B 24/0087; A63B 22/06; A63B 22/0605; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 23/0476; A63B 21/15; A63B 21/157; A61H 1/0214; A61H 2201/1238; A61H 2201/1246; A61H 2201/5051; A61H 2201/5056; Y10T 74/18568

USPC ..... 482/57–65; 601/36

See application file for complete search history.

(56) References Cited

U.S. PATENT DOCUMENTS

| | | | | |
|---|---|---|---|---|
| 2,320,489 | A * | 6/1943 | Turner et al. | 601/36 |
| 4,958,831 | A | 9/1990 | Kim | |
| 5,035,418 | A * | 7/1991 | Harabayashi | 482/62 |
| D320,826 | S | 10/1991 | Hildebrandt et al. | |
| D325,946 | S | 5/1992 | Cesaroni et al. | |
| 5,312,311 | A * | 5/1994 | Pearson | 482/57 |
| 5,336,147 | A * | 8/1994 | Sweeney, III | 482/57 |
| 5,338,272 | A * | 8/1994 | Sweeney, III | 482/57 |
| 5,769,480 | A | 6/1998 | Gebhardt | |
| 5,826,935 | A | 10/1998 | DeFreitas | |
| 6,752,459 | B2 | 6/2004 | Deisig | |
| 6,913,560 | B2 | 7/2005 | Ryan et al. | |
| 7,025,367 | B2 | 4/2006 | McKinnon | |

(Continued)

FOREIGN PATENT DOCUMENTS

GB 1402121 A * 8/1975

*Primary Examiner* — Oren Ginsberg
*Assistant Examiner* — Joshua Lee
(74) *Attorney, Agent, or Firm* — Schwegman Lundberg & Woessner, P.A.

(57) ABSTRACT

Seat post and handlebar post that may be used for upright and recumbent stationary bicycles with its height adjustments and tilt angles controlled and powered by mechanisms that allows the user to adjust each to their desired position while operating the bicycle.

16 Claims, 18 Drawing Sheets

(56) References Cited

U.S. PATENT DOCUMENTS

| | | | | |
|---|---|---|---|---|
| 7,083,180 | B2 | 8/2006 | Turner | |
| 7,281,374 | B2 | 10/2007 | Obayashi et al. | |
| 7,306,206 | B2 | 12/2007 | Turner | |
| 7,673,936 | B2 | 3/2010 | Hsu | |
| 7,682,286 | B2 * | 3/2010 | Badarneh et al. | 482/5 |
| 7,708,251 | B2 | 5/2010 | Watt et al. | |
| 7,971,937 | B2 | 7/2011 | Ishii et al. | |
| 8,002,092 | B2 | 8/2011 | McAndrews | |
| 8,021,277 | B2 | 9/2011 | Baudhuin | |
| 8,042,868 | B2 | 10/2011 | Sakai et al. | |
| 8,057,364 | B2 | 11/2011 | Goldberg | |
| 8,062,190 | B2 | 11/2011 | Pyles et al. | |
| 8,066,301 | B1 | 11/2011 | Westermann | |
| 8,078,366 | B2 | 12/2011 | Nagata et al. | |
| 8,079,772 | B1 | 12/2011 | Brennan et al. | |
| 8,092,346 | B2 | 1/2012 | Shea | |
| 8,092,352 | B2 | 1/2012 | Irving et al. | |
| 8,136,877 | B2 | 3/2012 | Walsh | |
| 8,272,999 | B2 | 9/2012 | Huyck et al. | |
| 8,328,454 | B2 | 12/2012 | McAndrews et al. | |
| 8,398,104 | B2 | 3/2013 | Hsu | |
| 8,506,457 | B2 | 8/2013 | Baudhuin | |
| 8,511,655 | B2 | 8/2013 | Wu | |
| 8,550,551 | B2 | 10/2013 | Shirai | |
| 8,573,624 | B2 | 11/2013 | Morelli | |
| 2002/0061804 | A1 * | 5/2002 | Hasegawa | 482/57 |
| 2003/0092534 | A1 * | 5/2003 | Forcillo | 482/57 |
| 2004/0208687 | A1 | 10/2004 | Sicz et al. | |
| 2005/0161576 | A1 | 7/2005 | Boehm et al. | |
| 2005/0239610 | A1 | 10/2005 | Ryan et al. | |
| 2005/0245358 | A1 * | 11/2005 | Mercado et al. | 482/52 |
| 2006/0058163 | A1 * | 3/2006 | Matsumoto | 482/62 |
| 2006/0066074 | A1 | 3/2006 | Turner | |
| 2006/0234836 | A1 * | 10/2006 | Kuo | 482/57 |
| 2006/0280552 | A1 | 12/2006 | Turner | |
| 2010/0222183 | A1 * | 9/2010 | Badarneh et al. | 482/57 |
| 2010/0273612 | A1 * | 10/2010 | Watt et al. | 482/57 |
| 2011/0049945 | A1 | 3/2011 | Mouri et al. | |
| 2011/0057485 | A1 | 3/2011 | Shirai | |
| 2011/0077125 | A1 * | 3/2011 | Kenyon | 482/4 |
| 2011/0082014 | A1 * | 4/2011 | Leonhard | 482/57 |
| 2011/0204201 | A1 | 8/2011 | Kodama et al. | |
| 2011/0257848 | A1 | 10/2011 | Shirai | |
| 2012/0329611 | A1 * | 12/2012 | Bouchard et al. | 482/57 |
| 2013/0072356 | A1 * | 3/2013 | Machida et al. | 482/58 |
| 2013/0123074 | A1 * | 5/2013 | Jun | 482/57 |
| 2013/0300163 | A1 | 11/2013 | Shirai | |
| 2014/0031173 | A1 * | 1/2014 | Huang | 482/57 |
| 2014/0031174 | A1 * | 1/2014 | Huang | 482/62 |

* cited by examiner

BICYCLE SEAT AND HANDLEBAR MECHANISMS

BACKGROUND OF THE INVENTION

1. Field of the Invention

This invention generally relates to stationary bicycle seat and handlebar positioning. The present invention relates to the height and position adjustment of stationary exercise bicycle seats and handlebars for both upright and recumbent stationary bicycles. The present invention allows the seat and handlebar height to be raised and lowered, or moved forward and back for recumbent bicycles, while the bicyclist is riding the bicycle. The present invention also allows the handlebar height and angle for stationary bicycles to be adjusted while the bicyclist is riding the bicycle.

2. Description of Prior Art

For decades bicycling has been very popular for exercise, rehabilitation for injuries and as a sport. There are indoor stationary bicycles in use world-wide for exercise and rehabilitation, with the two main categories of stationary exercise bicycles being upright and recumbent. The bicycle seat is normally supported on a bicycle frame and telescoping seatpost that adjusts to preset heights and secured by well-known methods by those familiar with bicycling, including pins, bolts and other mechanisms. The bicycle handlebars are normally supported on a bicycle frame and positioned to a preset height and secured by well-known methods by those familiar with bicycling, including pins, bolts and other mechanisms. The angle of the handlebars is in a fixed position.

The ability to adjust the height or position of the stationary bicycle seat is a very important aspect for correct leg extension and position to optimize the workout. If the seat height is incorrect or needs adjustment, current art requires the user to stop peddling, dismount the bicycle and adjust the seat height to a predetermined seat position only. This seat position may or may not be correct for each individual bicyclist. For a recumbent bicycle the same is predetermined when the bicyclist desires to move the seat forward or back. Currently the height of a stationary bicycle seat is adjustable to preset positions that limit the seat height positions, which may not be beneficial or optimal for all users. Because no two people are built the same, stationary bicycle users need the ability to adjust the seat height specifically to fit their body-type. For all persons and more importantly for those who require different seat heights or positions to use different leg muscles for rehabilitation of leg muscles, improvements are desired. Currently, when a new seat height is needed, an individual must stop riding, dismount, change the seat height to a predetermined height, remount the bicycle and resume training. With the numerous steps involved, having to stop the training and the limitations current art maintains, improvements are desired.

The ability to adjust the height or position of the stationary bicycle handlebar post is important for correct posture and to optimize the workout. Currently for a recumbent bicycle with the seat forward or back, as shown in FIG. 1A, the handlebars are in a permanently fixed position and usually in an awkward position, even preventing the bicyclist from peddling without hitting their knees on the handlebars. FIG. 1B illustrates the awkward unnatural arm extension when the recumbent seat is moved back. Currently the height position of an upright stationary bicycle handlebar is permanently fixed in a preset position, which means that there is only one ergonomically correct position, which corresponds to only one seat position. Because no two persons' bodies are built the same and individual's heights vary, stationary bicycle users require different handlebar heights just as they require different seat heights to optimize and comfortably workout. For all persons and more importantly for those who require different handlebar heights or positions, improvements are desired.

BRIEF SUMMARY OF THE INVENTION

Accordingly, the present invention provides an upright stationary bicycle seat height adjustment method in which the height of a bicycle seat may be adjusted while the stationary bicycle is inactive or when the bicyclist is peddling the bicycle. The bicyclist depresses and holds the up or down button which engages a mechanism to raise or lower the height of the seat. The bicyclist releases the aforementioned button when the desired height of the seat is reached. The bicyclist does not need to dismount the bicycle to adjust the seat height and may continue to pedal while the seat raises or lowers.

Another primary aspect of this invention is for recumbent stationary bicycles. For a recumbent stationary bicycle the seat may be moved forward or back while the stationary recumbent bicycle is inactive or while the bicyclist is peddling the bicycle. The bicyclist depresses and holds the forward or back button which engages a mechanism to move the seat forward or back. When the desired seat position is reached the bicyclist releases the aforementioned button. The bicyclist does not need to dismount the bicycle to adjust the seat position, and may continue to pedal while the seat moves forward or back.

Accordingly, the present invention provides for an upright stationary bicycle handlebar height adjustment method in which the height of the bicycle handlebars may be adjusted while the bicycle is in operation and bicyclist is peddling the bicycle or when the bicycle is dormant. The bicyclist depresses and holds the up or down button which engages a mechanism to raise or lower the height of the handlebar. The bicyclist may also depress and hold the tilt-forward or tilt-back button that engages a mechanism to tilt the handlebar post forward or back. The bicyclist releases the aforementioned button(s) when the desired position of the handlebar is reached. The bicyclist does not need to dismount the bicycle to adjust the handlebar position, and may continue to pedal while the handlebar position is adjusted.

Another primary aspect of this invention is for recumbent stationary bicycle handlebar positioning. For a recumbent stationary bicycle the angle of the handlebar post may be tilted forward or back while the recumbent stationary bicycle is in operation and the bicyclist is peddling the bicycle or when the bicycle dormant. The bicyclist depresses and holds the forward or back button that engages a mechanism to tilt the handlebar post forward or back. The bicyclist may also depress and hold the up or the down button which engages a mechanism to lengthen or shorten the handlebar post. When the desired handlebar position is reached the bicyclist releases the aforementioned button(s). The bicyclist does not need to dismount the bicycle to adjust the handlebar position, and may continue to pedal while the handlebar position is adjusted.

Further, the up and down or forward and back control buttons for the seat and handlebars are located on the handle bars, the computerized control panel or other such location convenient for the bicyclist, such as the seat for a recumbent bicycle. The control buttons may be in more than one location to allow for ease of access for the bicyclist.

Another primary aspect of this invention is the power needed for the mechanism in the bicycle can be A/C electrical power, D/C electrical power, or by the power generated from the bicyclist peddling the bicycle.

Contained in the base of the upright or recumbent stationary bicycle is a hydraulic mechanism which moves the seat position. The workings of hydraulics are common knowledge to those familiar with hydraulics.

Contained in the base of the upright or recumbent stationary bicycle is a pneumatic mechanism which moves the seat position. The workings of pneumatics are common knowledge to those familiar with pneumatics.

Contained in the base of the upright or recumbent stationary bicycle is a hydraulic mechanism that moves the handlebar position. The workings of hydraulics are common knowledge to those familiar with hydraulics Contained in the base of the upright or recumbent stationary bicycle is a pneumatic mechanism that moves the handlebar position. The workings of pneumatics are common knowledge to those familiar with pneumatics.

Contained in the base of the upright or recumbent stationary bicycle is a motorized mechanism that moves the seat position. The workings of the motorized mechanism is common knowledge to those familiar with worm gears, gear racks, rack and pinion gears, and other mechanical gears.

Contained in the base of the upright or recumbent stationary bicycle is a motorized mechanism that moves the handlebar position. The workings of the motorized mechanisms are common knowledge to those familiar with worm gears, gear racks, rack and pinion gears, and other mechanical gears.

Another primary aspect of this invention is the ability to save or program several custom seat positions and handlebar positions selected by the bicyclist. Once a desired seat and/or handlebar position is attained, the bicyclist presses the "save" or "program" button on the console or monitor and then presses the number or letter on the keypad to be associated with their customized height or position. To change the seat and/or handlebar from its current position to another saved position, the bicyclist presses the "go to" or similarly named button and then the corresponding number or letter on the keypad for the saved seat and/or handlebar position. Once selected, the necessary mechanical gears or hydraulic mechanisms are engaged and the seat and/or handlebars automatically adjust to the desired position. The bicyclist has the ability to program several custom positions that may also be saved into a customized workout program. This customized workout program allows for the seat and handlebar positions to be moved at preselected time intervals while the bicyclist is riding or peddling the bicycle. The aforementioned button names are as an example to clarify the intention of movements desired by the bicyclist and may change as needed.

BRIEF DESCRIPTION OF DRAWINGS

To enable a further understanding of the different aspects and the technological methods of the invention herein, the brief description of the drawings below is followed by the detailed description of the preferred embodiments.

DETAILED DESCRIPTION OF THE INVENTION

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1A:
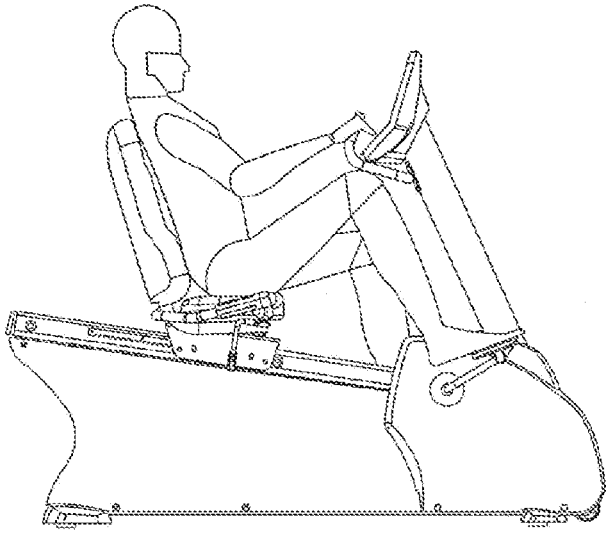
FIG. 1A Prior Art
FIG. 1A shows prior art of stationary recumbent bicycle with the seat moved forward and the bicyclist's knees hitting the handlebars. Handlebar is in fixed position.
Figure 1B:
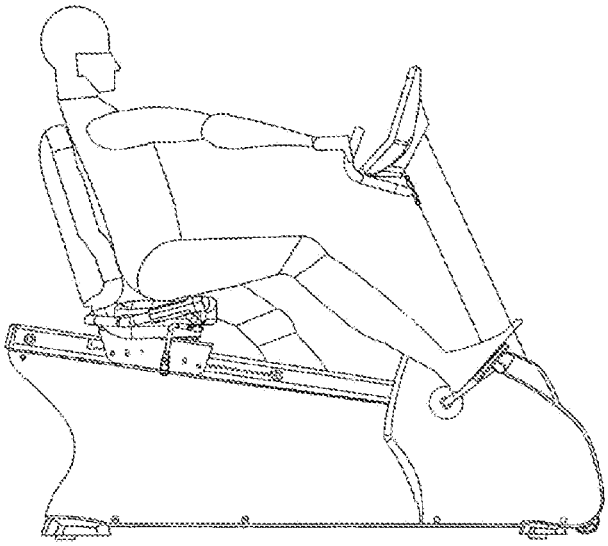
FIG. 1B Prior Art
FIG. 1B shows prior art of stationary recumbent bicycle with the seat moved back and the bicyclist's arms are overextended which moves the bicyclist's body into an unnatural and uncomfortable position. Handlebar is in fixed position.
Figure 2A:
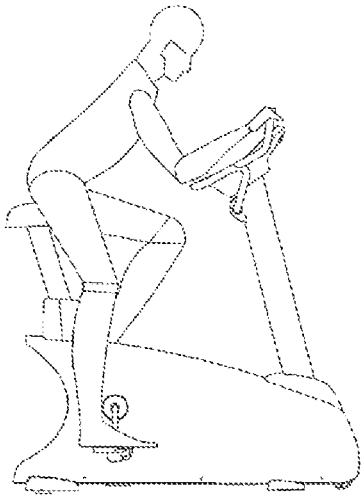
FIG. 2A shows prior art of a stationary upright bicycle with fixed handlebar position too low for a raised seat position.
Figure 2B:
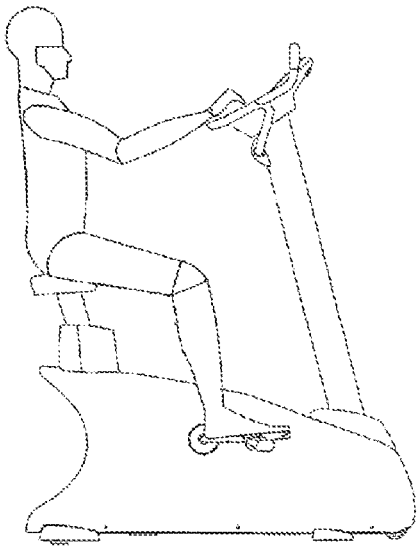
FIG. 2B shows prior art of a stationary upright bicycle with fixed handlebar position too high for a lowered seat position.
Figure 3A:
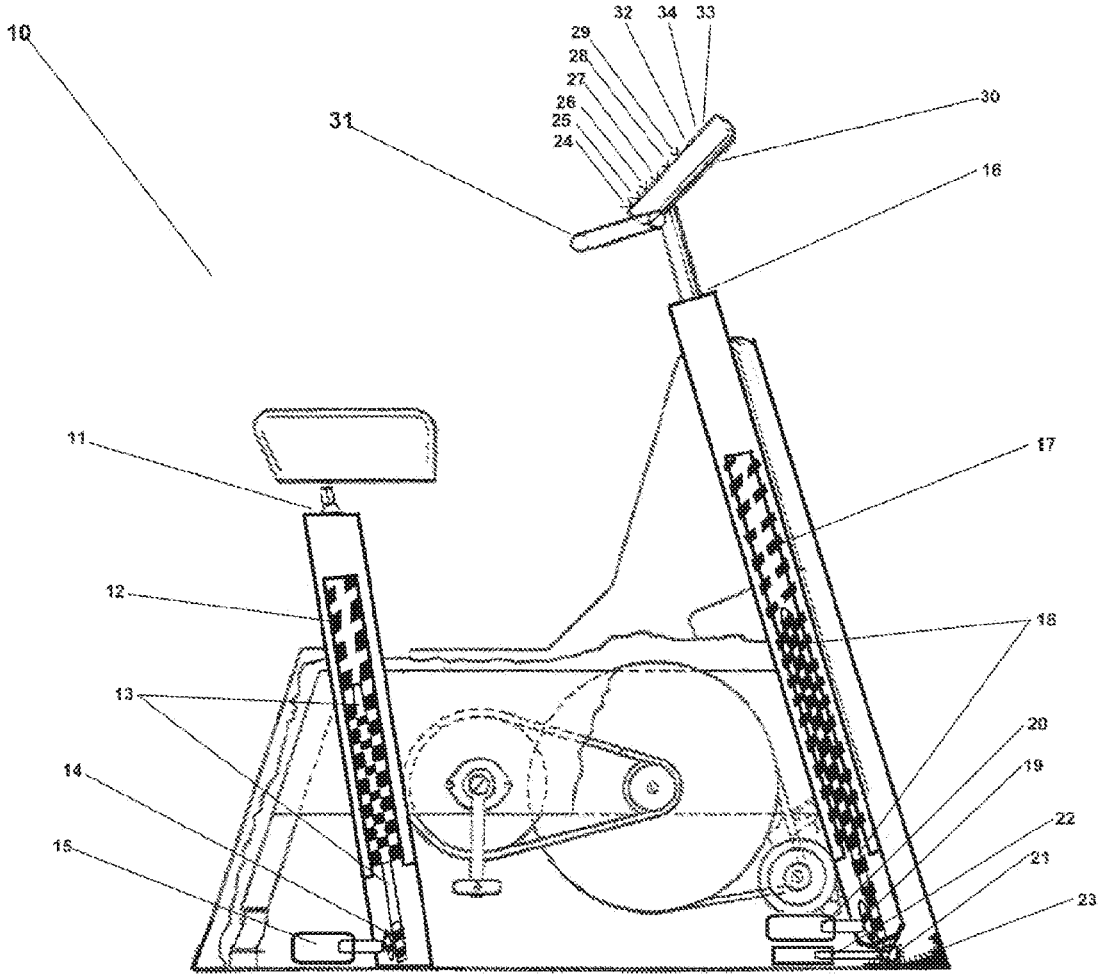
FIG. 3A shows a cutout side view of a stationary upright bicycle with the present invention's motorized gear embodiments for a lowered seat and handlebar.
Figure 3B:
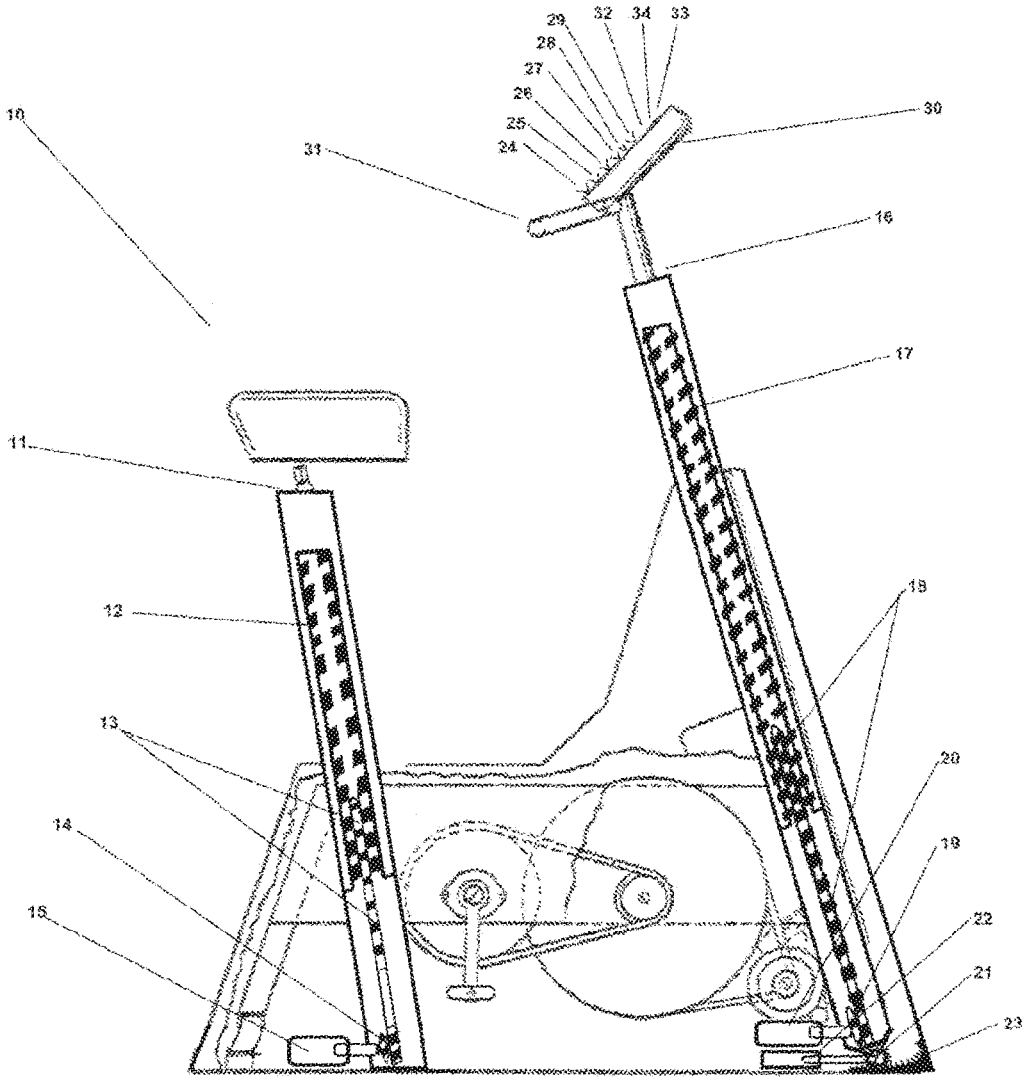
FIG. 3B shows a cutout side view of a stationary upright bicycle with the present invention's motorized gear embodiments for a raised seat and handlebar.

Illustrated in FIGS. 3A and 3B are cutout elevation views of an upright stationary bicycle 10 in which the height of the seat post 11 and handlebar post 16 can be adjusted while a bicyclist is riding or operating the stationary bicycle. FIG. 3A shows an upright stationary bicycle 10 with its seat post 11 and handlebar post 16 in a lower position. FIG. 3B shows an upright stationary bicycle 10 with its seat post 11 and handlebar post 16 in a raised position. At the base of the seat post 11 is a motorized mechanism 15 that powers the worm-gear mechanism 13 and 14 to raise and lower the seat post 11 to the rider's desired height. As the worm bar/post 13 spins, it causes the seat post support 12 to raise or lower depending if the worm bar/post 13 spins clockwise or counter-clockwise. The grooves in the worm bar/post 13 and the seat post support 12 are connected. At the base of the handlebar post 16 is a motorized mechanism 20 that powers the worm-gear mechanism 18 and 19 to raise and lower the handlebar post 16 to the rider's desired height. As the worm bar/post 18 spins it causes the handlebar post support 17 to raise or lower depending if the worm bar/post 18 spins clockwise or counter-clockwise. The grooves in the worm bar/post 18 and the handlebar post support 17 are connected. The motorized tilt mechanism 21 and 22 are also located at the base of the handlebar post 16 and provide the ability to tilt the handlebar post 16 to the bicyclist's desired position. When engaged, the tilt mechanism 21 rolls forward or back on the track 23 which causes the bottom of the handlebar post 16 to move forward or back, which causes the top of the handlebar post 16 to move the opposite way, thus causing the tilt angle desired. On the handlebar console/monitor 30 are the buttons 24, 25 to raise or lower the seat post 11. Also on the handlebar console/monitor 30 are buttons 26, 27, 28, 29 to raise or lower and tilt forward or back the handlebar post 16. When any of the buttons are pressed and held, they engage the corresponding motorized mechanism which causes the intended post to move until the button is released. If the bicyclist desires to save or program seat post 11 or handlebar post 16 positions, the bicyclist can press the "Save" button 32 on console/monitor 30 and then a desired number from keypad 33 on console/monitor 30. There may be additional buttons on the console/monitor 30. Buttons 24-29 may be on the handlebars 31 or console/monitor 30, depending if stationary bicycle has a console/monitor available for its model. To access a saved position, the bicyclist presses the "select" button 34 and then a number on the keypad 33 corresponding to the saved position requested. The present invention allows a bicyclist to adjust the height of a bicycle seat or height and position of the handlebars while riding or operating the bicycle by pressing the button corresponding to their intention. The bicyclist does not have to dismount the bicycle to adjust the position of the seat or handlebars. The present invention includes the ability for using one or more motorized mechanisms and motors to operate or fulfill one or more operations. The present invention uses mechanical gear technology, which is common knowledge to those familiar with mechanical gears.

Figure 4:
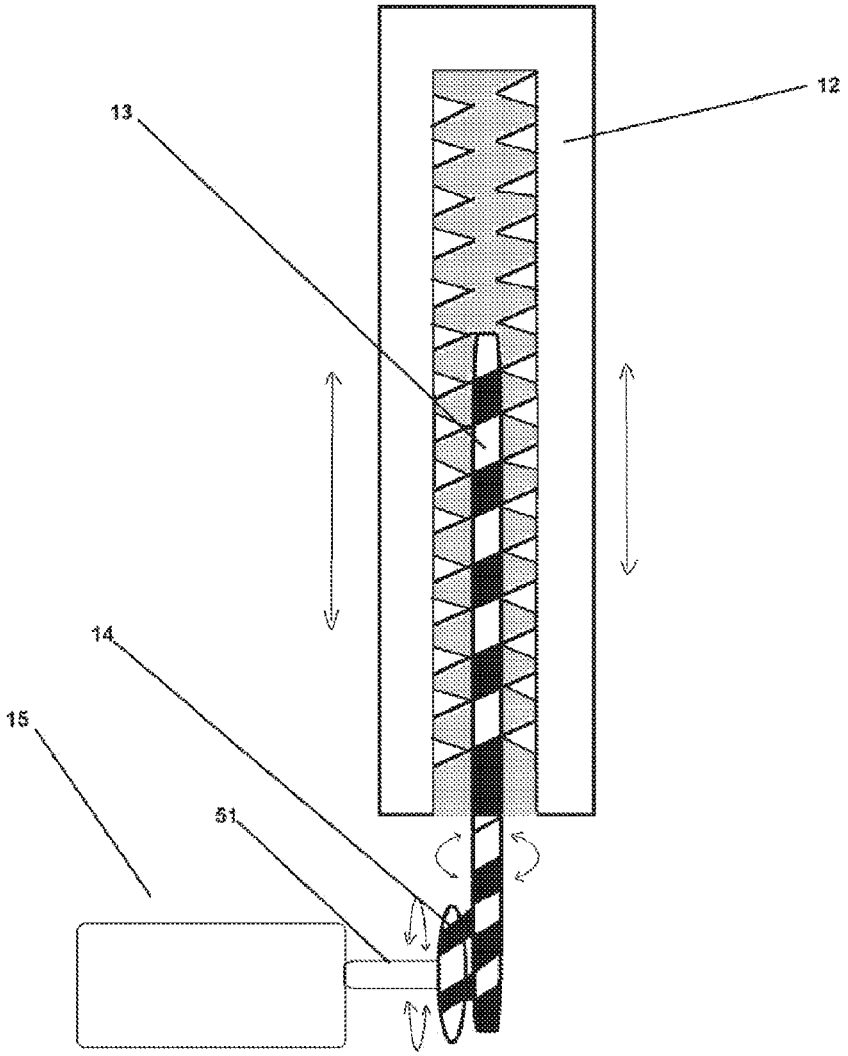
FIG. 4 shows a blow-up view of a stationary upright bicycle motorized gear mechanism for seat post in the present invention.

Illustrated in FIG. 4 is a blow-up cutout elevation view of the motorized seat post mechanism for the upright stationary bicycle. The seat post support 12 is connected to and contains the worm-gear post 13. The worm-gear post 13 works in direct relation to the worm-gear mechanism 14, which is powered by the motor 15. When the motor 15 spins the rod 51 that is connected to the worm gear 14, the worm-gear 14 spins, causing the worm-gear post 13 to spin. When the worm-gear post 13 spins it cause the seat post support 12 to raise or lower, depending upon if the worm-gear post 13 is spinning clockwise or counter-clockwise. The seat post support 12 has grooves that are connected to the grooves of the worm-gear rod.

Figure 5A:
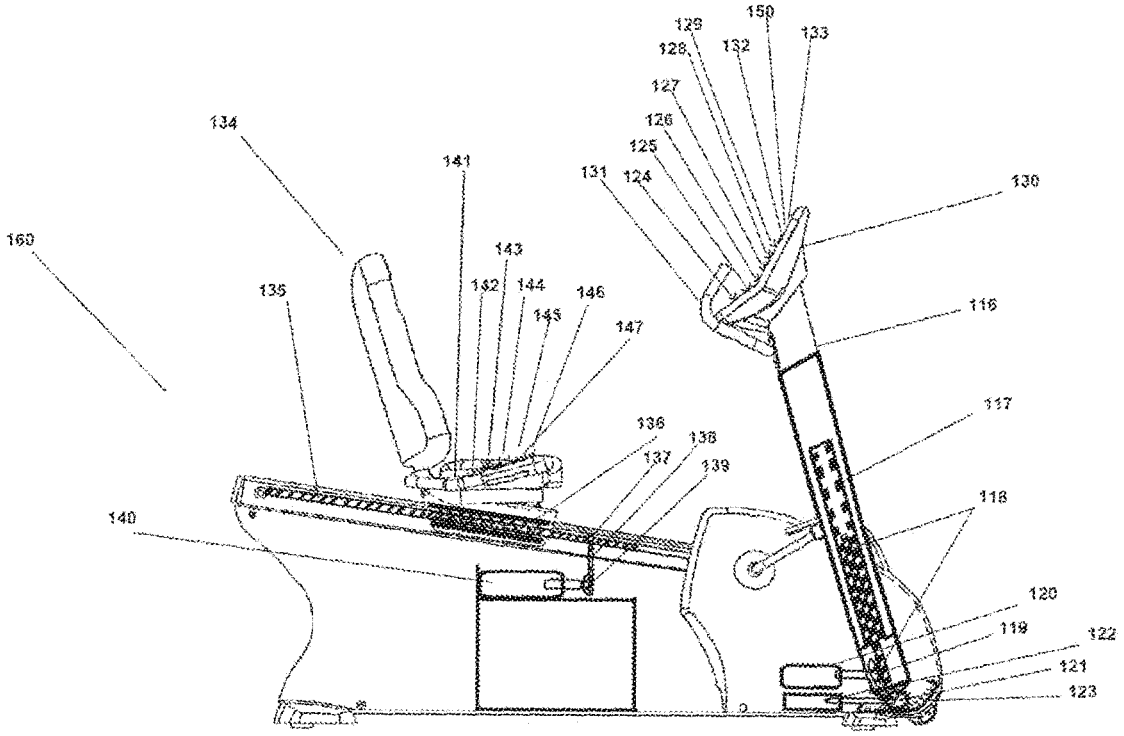
FIG. 5A shows a cutout side view of a stationary recumbent bicycle with the present invention's motorized gear embodiments with seat forward and handlebar retracted.
Figure 5B:
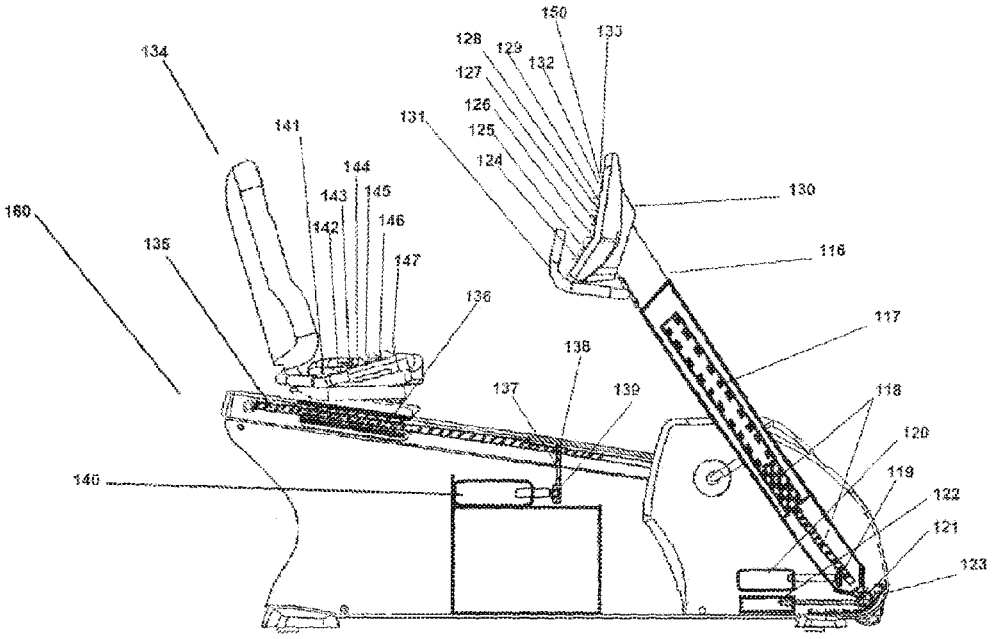
FIG. 5B shows a cutout side view of a stationary recumbent bicycle with the present invention's motorized gear embodiments with seat back, handlebar tilted and extended.

Illustrated in FIGS. 5A and 5B are cutout elevation views of a recumbent stationary bicycle 160 in which the position of the seat 134, the seat-post-worm-bar/post 135 and handlebar post 116 can be adjusted while a bicyclist is riding or operating the stationary bicycle 160. FIG. 5A shows a recumbent stationary bicycle 160 with its seat 134 in a forward position and its handlebar post 116 in a lower, standard position. FIG. 5B shows a recumbent stationary bicycle 160 with its seat 134 in a back or extended position and its handlebar post 116 in a tilted back and extended or elongated position. Under the base of the seat-post-worm-bar/post 135 is a motorized mechanism 140 that powers the worm-gear mechanism 138 and 139 to move the seat-post-worm-bar/post 135 forward or back to the rider's desired length. As the worm bar/post 138 spins, it causes the worm-gear 137 to spin which activates the seat-post-worm-bar/post 135 to spin, which causes the seat support 136 to move forward or back depending if the seat-post-worm-bar/post 135 spins clockwise or counter-clockwise. The grooves in the seat-post-worm-bar/post 135 and the seat post support 136 are connected or coupled together. At the base of the handlebar post 116 is a motorized mechanism 120 that powers the worm-gear mechanism 118 and 119 to raise and lower the handlebar post 116 to the rider's desired height. As the worm bar/post 118 spins it causes the handlebar post support 117 to raise or lower depending if the worm bar/post 118 spins clockwise or counter-clockwise. The grooves in the worm bar/post 118 and the handlebar post support 117 are connected or coupled together. The motorized tilt mechanism 121 and 122 are also located at the base of the handlebar post 116 and provide the ability to tilt the handlebar post 116 to the bicyclist's desired position. When engaged, the tilt mechanism 121 rolls forward or back on the track 123 which causes the bottom of the handlebar post 116 to move forward or back, which causes the top of the handlebar post 116 to move the opposite way, thus creating the desired tilt angle. The present invention allows a rider of a recumbent stationary bicycle to adjust or position the handlebars, via it handlebar post 116, to the desired length and angle while riding the bicycle, thereby the tendency for the rider's knees to hit the handlebars while riding. On the handlebar console 130 are buttons 124 and 125 which control the movement of the seat post 135, ultimately moving the seat 134 forward or back, as previously described. Also on the handlebar console 130 are buttons 126, 127, 128 and 129 which raise or lower and tilt forward or back the handlebar post 116, as previously described in this paragraph. When any of the buttons are pressed and held, they engage the corresponding motorized mechanism which causes the intended post to move. If the bicyclist desires to save or program the seat post or handlebar positions, the bicyclist can press the "save" or "program" button 132 on console 130 and then a number on the keypad 133, also located on the console 130. Buttons may be placed directly on the handlebars 131 if no console 130 is available in certain style bicycles. Additional control buttons 142-147 to activate the desired change in the seat and handle bar position may also be on the seat handle 141. If the bicyclist wants to access a saved seat and or handlebar position, the bicyclist presses the "select", or similarly named, button 150 and a number on the keypad 133, which then engages the mechanisms to move the seat and handlebars to the saved position. The present invention allows a bicyclist to adjust the position of the bicycle seat or height and position of the handlebars while riding or operating the bicycle by pressing the button corresponding to their intention. The bicyclist does not have to dismount the bicycle to adjust the position of the seat or handlebars. The present invention includes an option for using less than three motors to operate the mechanisms. The present invention uses mechanical gear technology, which is common knowledge to those familiar with mechanical gears.

Figure 6:
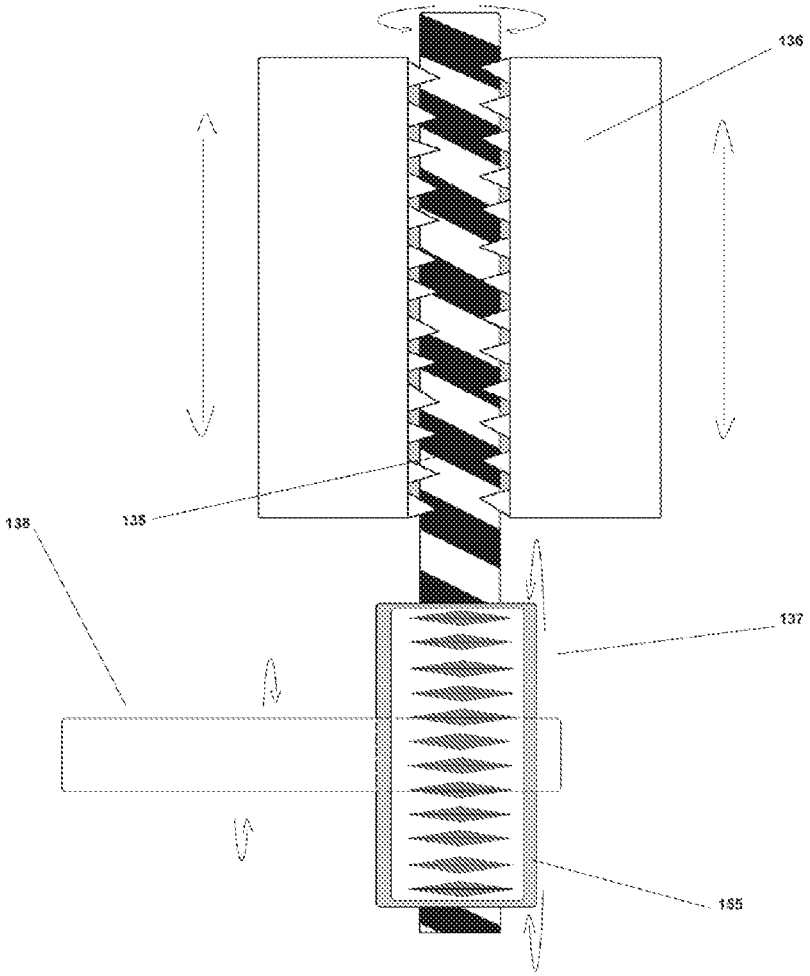
FIG. 6 shows a blow-up view of a stationary recumbent bicycle motorized gear mechanisms for a seat post in the present invention.

Illustrated in FIG. 6 is a blow-up cutout elevation view of the underside of the seat support 136. Attached to the rod 138 is the worm-gear 137. When rod 138 spins, it spins the wheel 155 of the worm gear 137 which cause the seat-post-worm-bar/post 135 to spin, which causes the seat support 136 to move forward or back on the seat-post-worm-bar/post 135. The seat support 136 has grooves on its underside that are linked or coupled to the seat-post-worm-bar/post 135 and thereby moves forward or back when the seat-post-worm-bar/post 135 spins clockwise or counter-clockwise.

Figure 7:
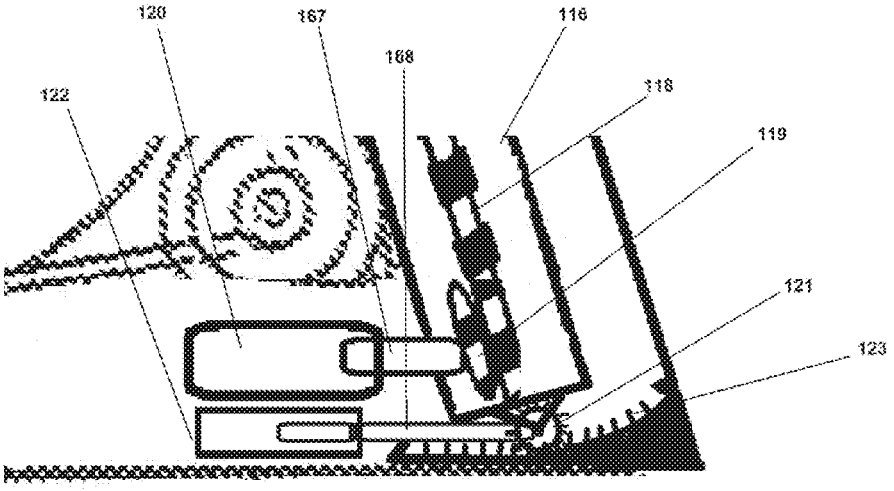
FIG. 7 shows a blow-up view of stationary bicycle with motorized gear mechanism for a handlebar post and a motorized tilt mechanism for a handlebar post in the present invention.

Illustrated in FIG. 7 is a blow-up cutout elevation view of the handlebar tilt mechanism. The tilting mechanism is comprised of the motor 122, the extending rod 168, a wheel 121 and a track 123. When the tilt mechanism is activated it engages the motor 122 to push or pull the extending rod 168 which causes the wheel 121 to move forward or back on the track 123. When the wheel 121 moves it causes the base of the handlebar support 116 to move forward or back which makes the top of the handlebar support move in the opposite direction, thereby changing the angle of the handlebars.

FIGS. 3A, 3B, 4, 5A, 5B, 6, 7 are examples of worm-gears and are not intended to limit the scope of this invention to only worm-gears. The present invention can utilize other mechanical gears or can use other gear mechanisms in conjunction with the worm-gear to perform the necessary operations. One example of another gear mechanism that can be used is rack-and-pinion. The movements and use of mechanical gears are common knowledge to those familiar with mechanical gears.

Figure 8:
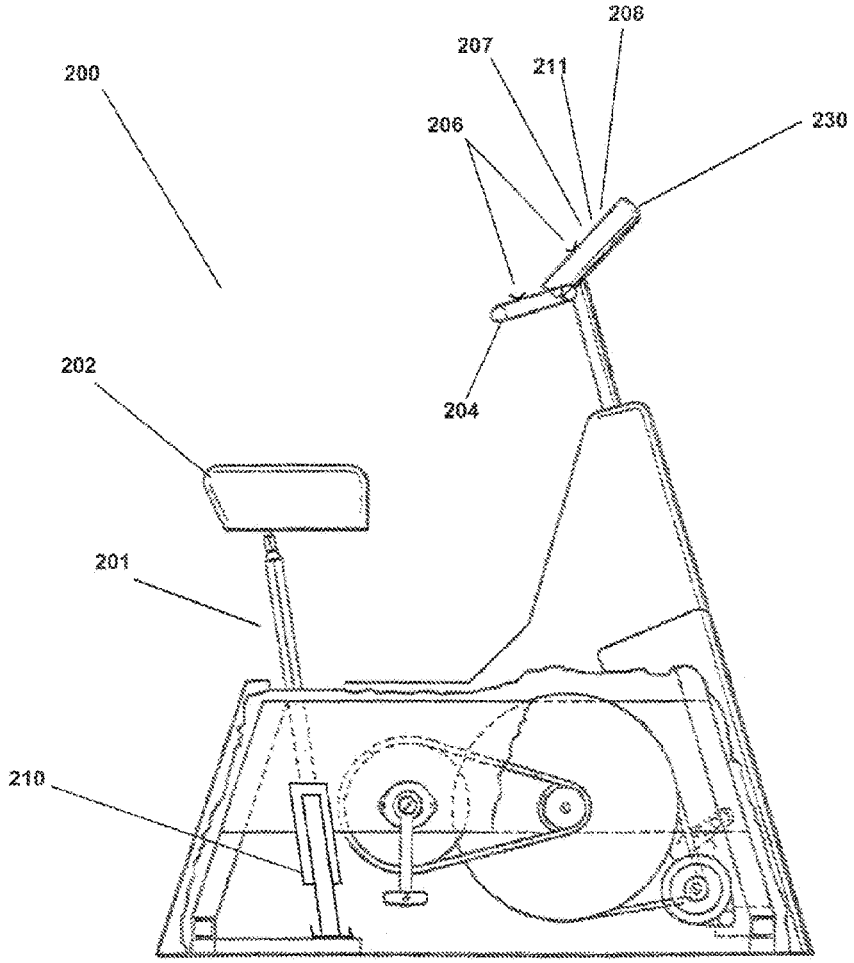
FIG. 8 shows a cutout side view of an upright stationary bicycle with the hydraulic seat post that adjusts the height of the seat.

FIG. 8 shows a cutout elevation view of an upright stationary bicycle 200. The present invention allows a bicyclist to adjust the height of the seat 202 while riding or operating the bicycle. The bicyclist presses and holds the up/down button 206, which may be located on the handle bars 204, program monitor display 205 or other convenient locations, to raise or lower the height of the seat post 201 to the desired height and then releases the button 206. The bicyclist does not have to dismount the bicycle to adjust the height of the seat and may do so while actively riding the bicycle. When a bicyclist presses and holds the up/down button 206, it engages the hydraulic mechanism 210 which raises or lowers the seat post 201 until the button is released at the desired height. The present invention allows for desired seat position to be saved or programmed by pressing the save/program button 207 and a number on the keypad 208. To access a saved position, the bicyclist presses the "select" button 211 and a number on the keypad 208 which activates the hydraulic mechanism 210 and moves the seat post 201 to the saved position. The bicyclist may save or program more than one height. The present invention uses standard hydraulic technology, which is common knowledge to those familiar with hydraulics.

Figure 9A:
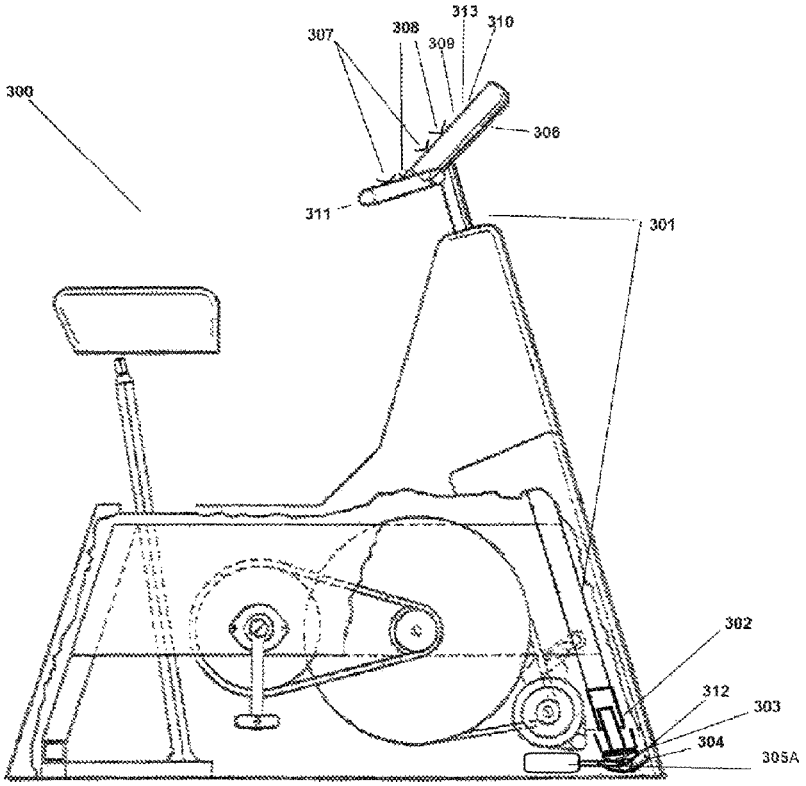
FIG. 9 shows a cutout side view of an upright stationary bicycle showing the hydraulic mechanism that moves the height of the handlebar post up and down.
Figure 9B:
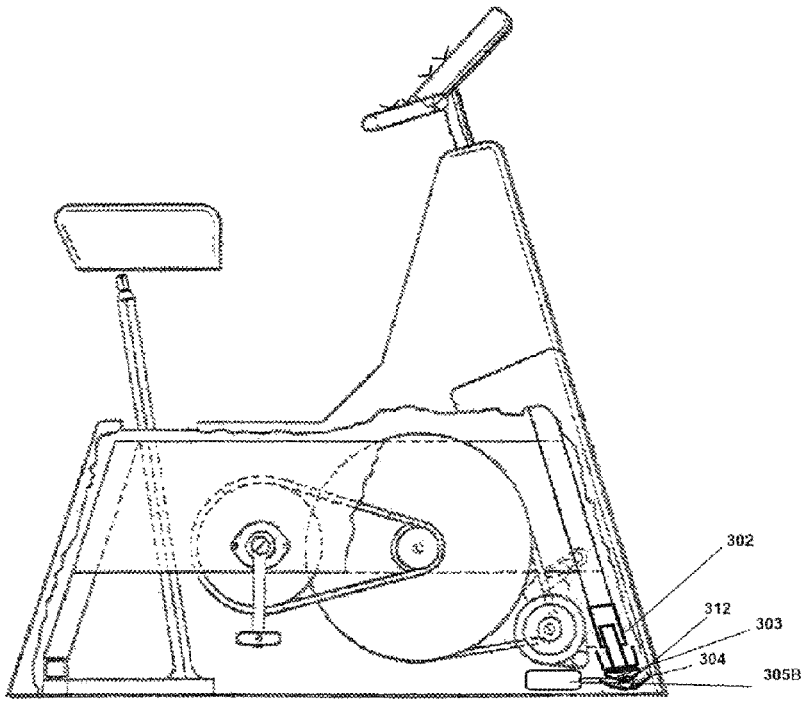

FIGS. 9A-9B is a cutout elevation view of an upright stationary bicycle 300 in which the hydraulic mechanism 302 can be used to adjust the height of the handlebar post 301. At the base of the handlebar post 301 is the hydraulic mechanism 302 used to raise or lower the height of the handlebar post 301 to a desired position. The present invention allows a bicyclist to adjust the position of the handlebar post 301 while actively riding the bicycle. The bicyclist presses and holds the up/down button 307 which engages the hydraulic mechanism 302 to raise or lower the handlebar post 301 until the button is released by the bicyclist at the desire height. The bicyclist may also tilt the handlebar post 301 forward or back by pressing and holding the tilt forward/back button 308, which activates the tilt motor 305A thereby engaging the tilt mechanism 303 which pushes/pulls the roller 312 that rolls the bottom of the handlebar post 301 forward or back on the track 304, which causes the top of the handlebar post 301 to move the opposite way, giving the bicyclist the desired angle of the handlebars when the button is released. FIG. 9A depicts a mechanical tilt motor 305A, and FIG. 9B depicts the same tilt operation using a hydraulic or pneumatic mechanism 305B. The bicyclist can save the desired position of handlebars by pressing the save/program button 309 on the handlebar console/monitor 306. To access a saved position, the bicyclist presses the "select" button 313 and a number on the keypad 310 which activates the hydraulic mechanism 302 and tilt mechanism 303, moving the handlebar post 301 to the saved position. The up/down button 307 and the tilt forward/back button 308 can be located on the handlebar monitor 306 or on the handlebars 311, if no monitor is available for a particular bicycle. The present invention allows a bicyclist to adjust the height or position of the handlebars while riding or operating the bicycle. The bicyclist does not have to dismount the bicycle to adjust the position of the handlebars. The present invention uses standard hydraulic technology, which is common knowledge to those familiar with hydraulics.

Figure 10:
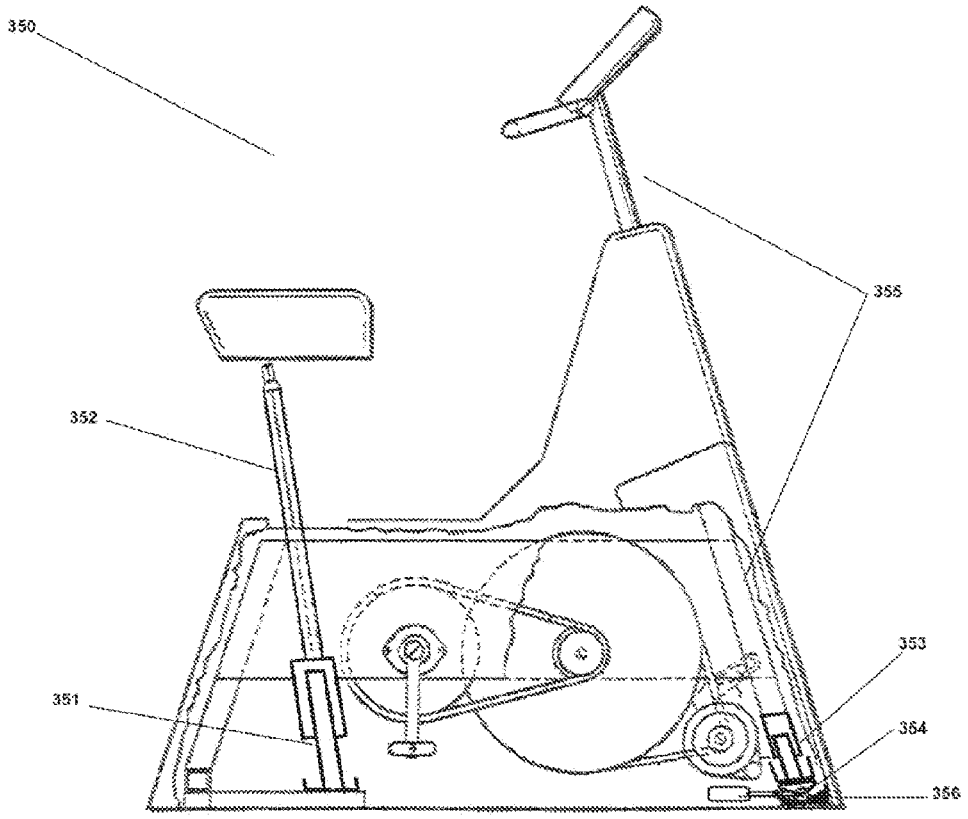
FIG. 10 shows a cutout side view of an upright stationary bicycle with the hydraulic seat post, hydraulic handlebar post, and handlebar tilt mechanism, to adjust the height of the seat, and handlebars and adjust the angle of the handlebars.

FIG. 10 is a cutout elevation view of an upright stationary bicycle 350 that illustrates the present invention with hydraulic mechanism 351, which move the seat post 352 up and down, and hydraulic mechanism 353, which moves the handlebar post 355 up and down. Also illustrated are the tilt motor 356 and the tilt mechanism 354 which tilt the handlebar post 355 forward and back. The hydraulic mechanisms, processes, activations, and button locations have been described in detail in previous paragraphs. The present invention uses standard hydraulic technology, which is common knowledge to those familiar with hydraulics.

Figure 11:
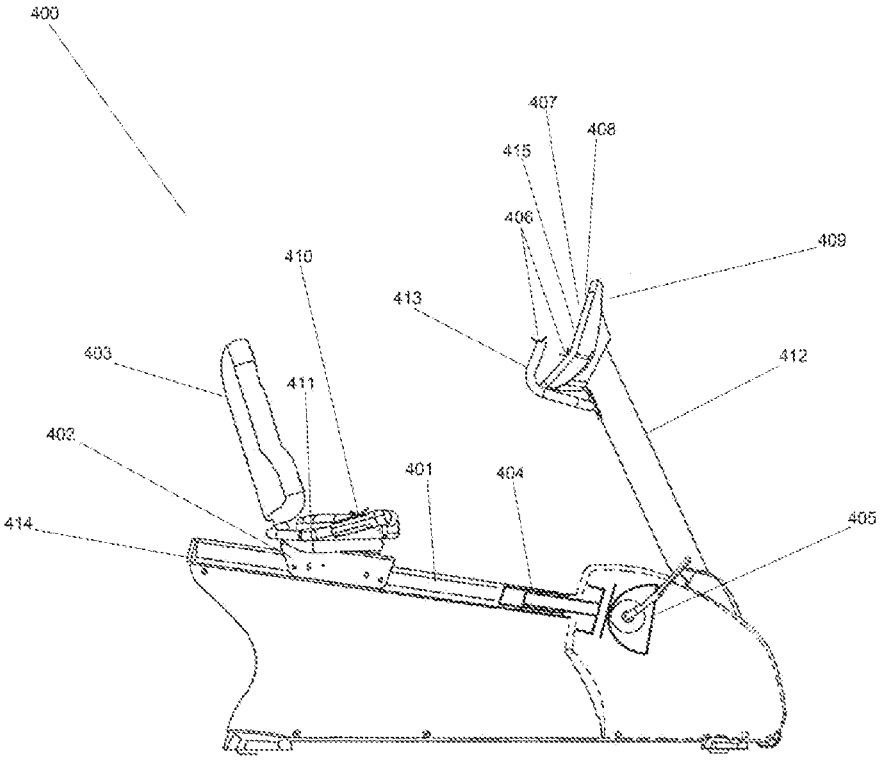
FIG. 11 shows a cutout side view of a recumbent stationary bicycle with the hydraulic seat post that adjusts the position of the seat forward or back.

FIG. 11 is a cutout elevation view of a recumbent stationary bicycle 400 in which the seat 403 can be moved forward or back while the bicyclist is actively riding the bicycle. The bicyclist presses and holds the forward/back button 406 which activates the hydraulic mechanism 404 that moves the seat post 401 forward or back until the button is released at the desired position. The seat post 401 is connected to the seat support 402. At the base of the seat post 401 is the hydraulic mechanism 404 used to move the seat forward or back. There is a support unit 405 for the hydraulic mechanism 404. The forward/back button 406 can be located on the handlebar monitor/console 409, the handlebars 413, the seat handlebar 411 or any combination depending on the style of recumbent stationary bicycle. If the bicyclist would like to save a seat position, the bicyclist presses the save/program button 407 and a number on the keypad 408, both located on the handlebar monitor/console 409. When the bicyclist would like to move the seat 403 to a saved or programmed position, the bicyclist presses the "select" button 415 and the number associated with desired seat position from the keypad 408 and the hydraulic mechanism 404 activates, which moves the seat post 401 and seat support 402 to the desired position. The present invention uses standard hydraulic technology, which is common knowledge to those familiar with hydraulics.

Figure 12A:
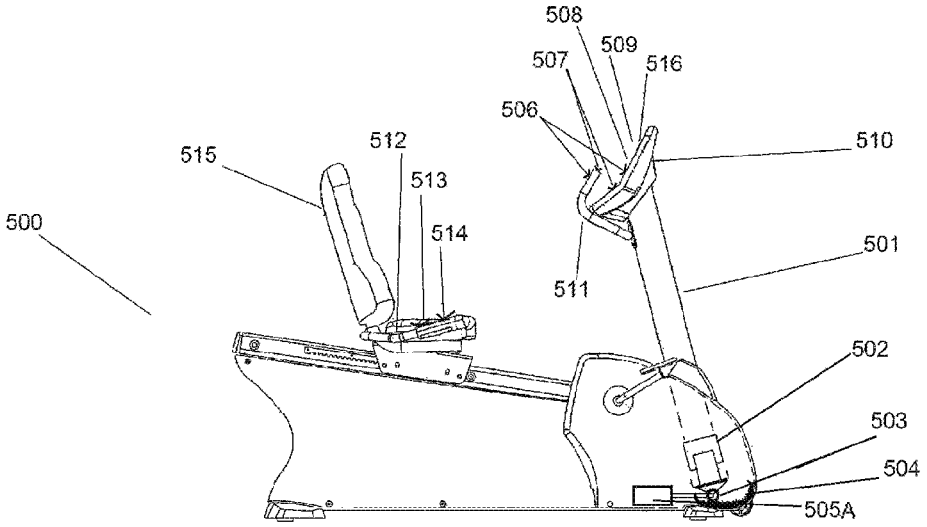
FIG. 12A shows a cutout side view of a recumbent stationary bicycle with its seat in a forward position and handlebars in standard position and with the hydraulic mechanism that moves the handlebar post position and a motorized mechanism to tilt the handlebars post.
Figure 12B:
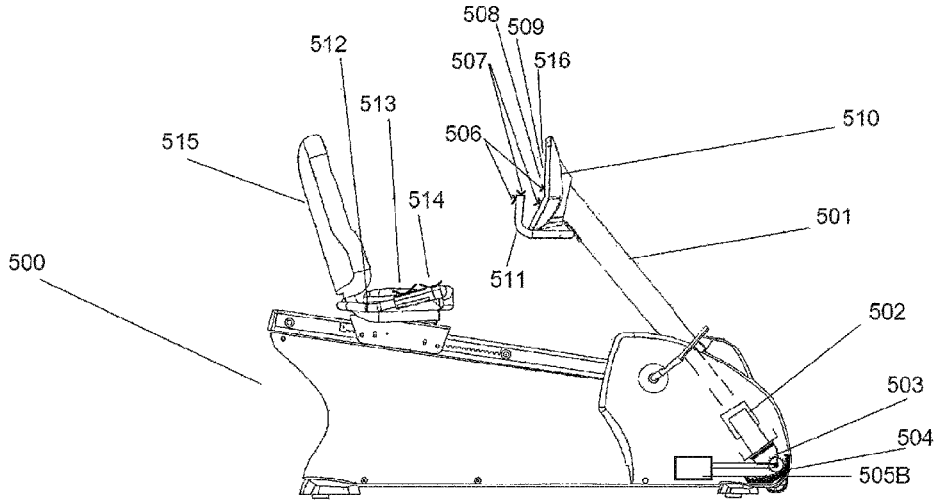
FIG. 12B shows a cutout side view of a recumbent stationary bicycle with its seat in a back position, handlebars lengthened, and handlebars at a lower angle and with the hydraulic mechanism that moves the handlebar post position and a motorized mechanism to tilt the handlebars post.
Figure 12C:
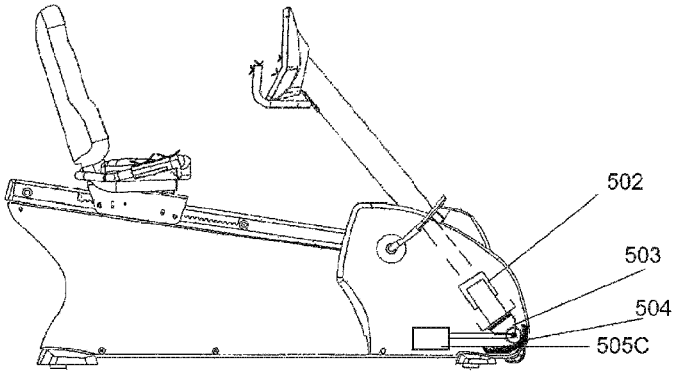
FIG. 12C shows a cutout side view of a recumbent stationary bicycle with its seat in a back position, handlebars lengthened, and handlebars at a lower angle and with the hydraulic mechanism that moves the handlebar post position and a hydraulic or pneumatic mechanism to tilt the handlebar post.

Illustrated in FIGS. 12A-12C are cutout elevation views of recumbent stationary bicycle 500 in which the position of handlebar post 501 can be adjusted forward or back and up or down to a desired position while the bicyclist is actively riding the bicycle. FIG. 12A shows recumbent stationary bicycle 500 with the seat 515 in a forward position and handlebar post 501 and handlebar 511 in a more upright position. FIG. 12B shows recumbent stationary bicycle 500 with the seat 515 in a back position and handlebar post 501 and handlebar 511 in a lengthen position and at a lower angle. At the base of the handlebar post 501 is a hydraulic mechanism 502 used to lengthen or shorten the handlebar post 501. Also at the base of the handlebar post 501 is a tilting mechanism 503 that can tilt or change the angle of the handlebar post 501 up or down to position the handlebars 511 and handlebar post 501 to a desired position above the bicyclist's legs. The lengthen/shorten, longer/shorter, up/down or similarly named button 506 and the tilt up/down button 507 can be located on the handlebar monitor/console 510 or on the handlebars 511 if no monitor/console is available for certain bicycles. An additional lengthen/shorten button 513 and additional tilt up/down button 514 may be located on the seat handle 512, which may be more convenient for bicyclist. If the bicyclist want to save a seat and/or handlebar position, the bicyclist may press the save button 508 and a number on the keypad 509 to save the position(s). When the bicyclist would like to move the handlebar post 501 to a saved or programmed position, the bicyclist presses the "select" button 516 and the number associated with desired handlebar position from the keypad 509 and the hydraulic mechanism 502 and tilt mechanism 503 activate, which moves the handlebar post 501 to the desired position. The present invention allows a bicyclist to adjust the position of the handlebars while actively riding the bicycle. To change the angle of the handlebars, the bicyclist presses and holds the tilt button 507 until desired handlebar position is reached, then releases the button. When the bicyclist presses and holds the tilt button 507 located on the program monitor/console 510 or the handlebars 511 if monitor/console is unavailable, it activates the tilt motor 505A-505B thereby engaging the tilt mechanism 503 which pushes/pulls the bottom of the handlebar post 501 forward or back on the track 504, which causes the top of the handlebar post 501 to move the opposite way, resulting in the desired height above their legs. FIGS. 12A-12B depicts a mechanical tilt motor 505A, and FIG. 12C depicts the same tilt operation using a hydraulic or pneumatic mechanism 505C. To lengthen or shorten the handlebar post 501 so the bicyclist's hands rest comfortably on the handlebars 511, the bicyclist presses and holds the lengthen/shorten button 506 until desired length is reached, then releases the button. When the bicyclist presses and holds the lengthen/shorten buttons 506 located on the handlebars 511, program monitor/console 510 or other convenient location, it activates the hydraulic mechanism 502 which moves the handlebar post 501 up or down, thereby lengthening or shortening it to the bicyclist's desired position. Additional tilt buttons 514 and additional length button 513 may be located on the seat handle 512. The bicyclist does not have to dismount the bicycle to adjust the position of the handlebars. The present invention uses standard hydraulic technology, which is common knowledge to those familiar with hydraulics.

Figure 13:
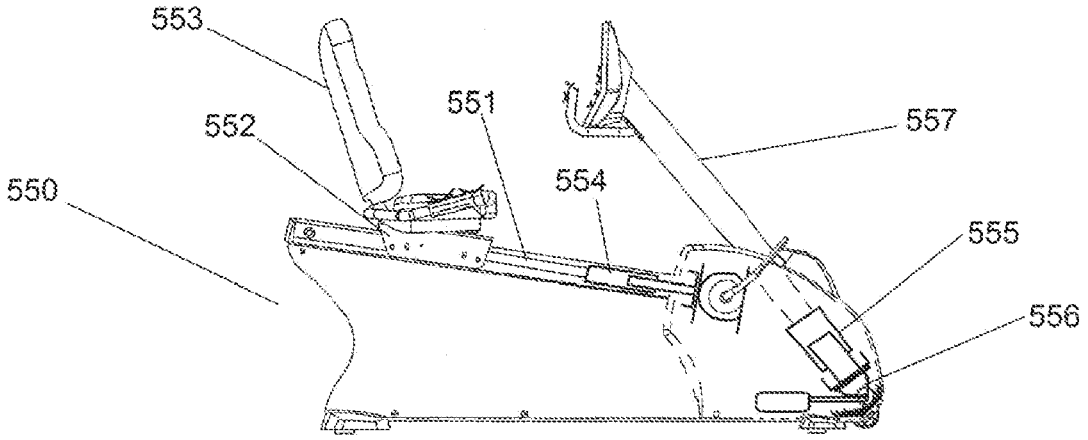
FIG. 13 shows a cutout side view of a recumbent stationary bicycle with the hydraulic seat post, hydraulic handlebar post, and tilt mechanism, to adjust the positions of the seat and handlebars.

FIG. 13 shows a cutout elevation view of recumbent bicycle 550 with its seat 553 in a back position and its handlebar post 558 lengthened and at a lower angle. Illustrated is the present invention utilizing hydraulic mechanism 554 to move the seat post 551, which moves the seat support 552 and seat 553. Also illustrated is the present invention utilizing hydraulic mechanism 555 to move the handlebar post 557. Also illustrated is the present invention utilizing a tilt mechanism 556 to adjust or tilt the handlebar post 552. The processes and activations, as well as button locations, have been described in previous paragraphs. The present invention uses standard hydraulic technology, which is common knowledge to those familiar with hydraulics.

FIGS. 8, 9, 10, 11, 12, 13 illustrate use of hydraulics and are not intended to limit the scope of this invention to only hydraulics. The present invention can utilize other cylinder devices, such as pneumatic cylinders, in place of the illustrated and discussed hydraulic devices or hydraulic mechanisms to perform the necessary operations, and does not confine the present invention to just hydraulic cylinders. The movements and use of pneumatics devices are common knowledge to those familiar with pneumatics.

Figure 14A:
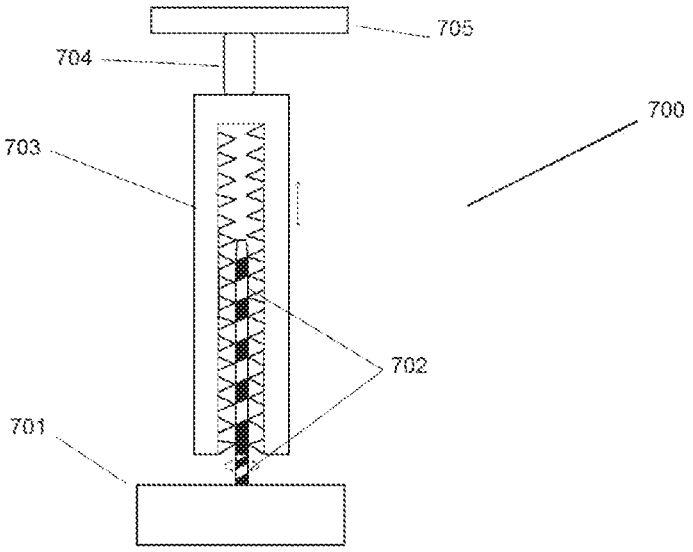
FIG. 14A shows a blow-up view of a stationary bicycle seat post with the motorized spinning-rod gear.

FIG. 14A shows a blow-up view of a stationary bicycle seat post 704 and seat post support 703 with the motorized spinning-rod gear mechanism 700. Illustrated is the present invention utilizing a motorized spinning rod gear mechanism 700 for moving a stationary bicycle seat post 704 and seat 705 while the bicyclist is peddling the bicycle. When the motorized spinning rod gear mechanism 700 is activated or engaged, the motor 701 spins or rotates the grooved-rod 702, which is coupled with the seat post support 703, causing the seat post support 703 to move. As an example, in the case of an upright stationary bicycle, the seat post support 703 would raise or lower in correlation with the grooved-rod 702 spinning or rotating clockwise or counterclockwise, ultimately raising or lowering the seat 705 of the stationary bicycle. The seat post support 703 and grooved-rod 702 may use other coupling or connecting gear mechanisms and the example in this paragraph is to illustrate one coupling mechanism to be used in the present invention and does not limit the scope of the present invention to this one example. The present invention uses mechanical gear technology, which is common knowledge to those familiar with mechanical gears.

Figure 14B:
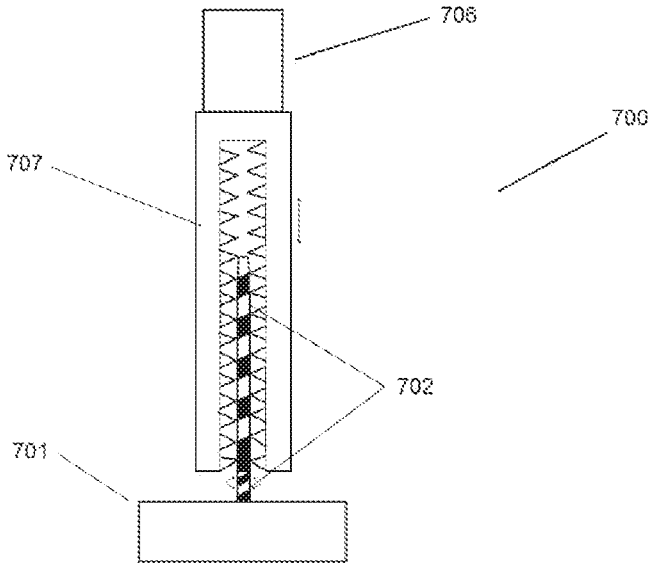
FIG. 14B shows a blow-up view of a stationary bicycle handlebar post with a motorized spinning-rod gear.

FIG. 14B shows a blow-up view of a stationary bicycle handlebar post 706 and handlebar post support 707 with the motorized spinning-rod gear mechanism 700. Illustrated is the present invention utilizing a motorized spinning rod gear mechanism 700 for moving a stationary bicycle handlebar post 706, which ultimately moves the handlebars of a stationary bicycle while the bicyclist is peddling the bicycle. When the motorized spinning rod gear mechanism 700 is activated or engaged, the motor 701 spins or rotates the grooved-rod 702, which is coupled with the handlebar post support 707, causing the handlebar post support 707 to move. As an example, in the case of an upright stationary bicycle, the handlebar post support 707 would raise or lower in correlation with the grooved-rod 702 spinning or rotating clockwise or counterclockwise, ultimately raising or lowering the handlebars of the stationary bicycle. The handlebar post support 707 and grooved-rod 702 may use other coupling or connecting gear mechanisms and the example in this paragraph is to illustrate one coupling mechanism to be used in the present invention and does not limit the scope of the present invention to this one example. The present invention uses mechanical gear technology, which is common knowledge to those familiar with mechanical gears.

Figure 15:
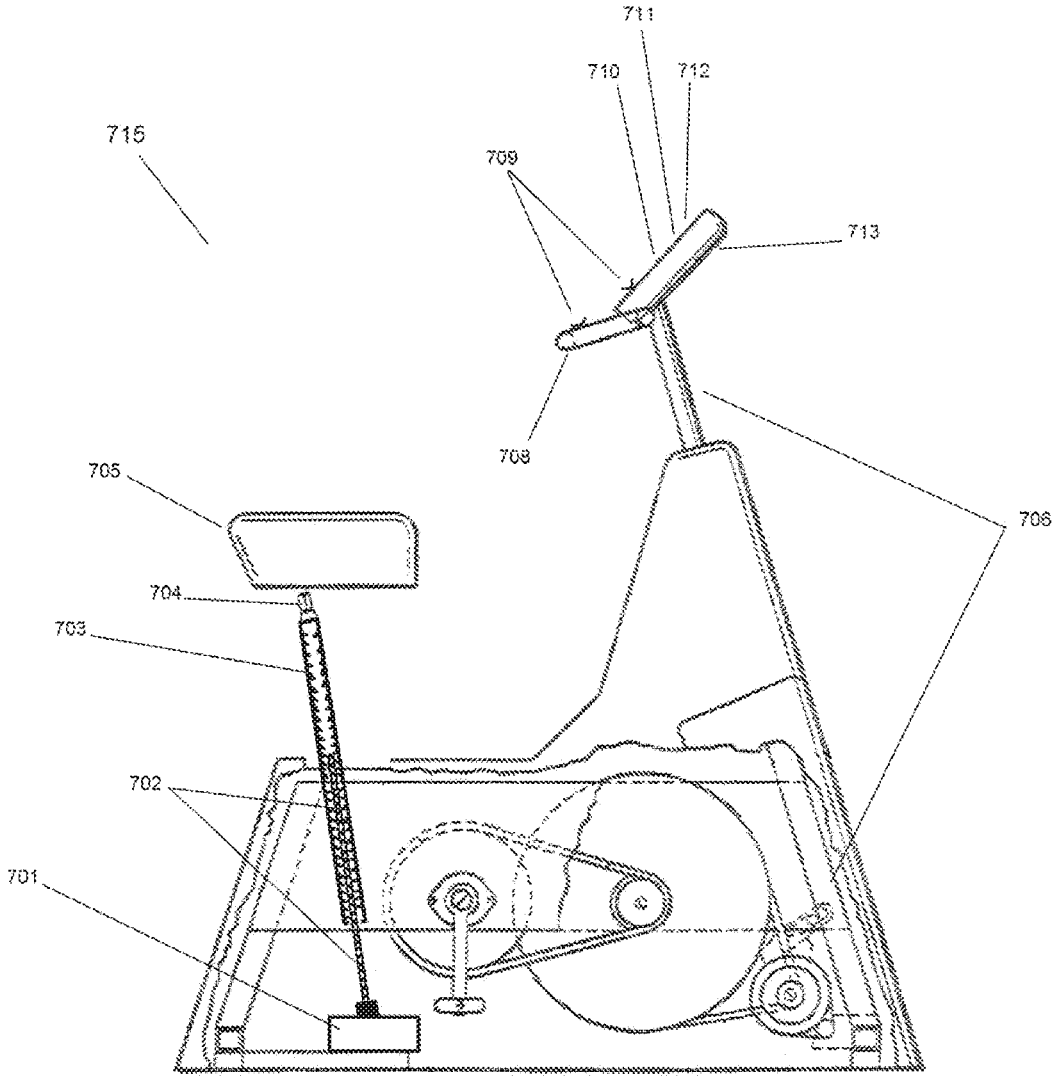
FIG. 15 shows a cutout side view of an upright stationary bicycle with the motorized spinning-rod gear seat post that raises and lowers the bicycle seat.

FIG. 15 shows a cutout side view of upright stationary bicycle 715. Illustrated is the present invention utilizing a spinning-rod gear mechanism comprised of the motor 701, grooved-rod 702, and seat post support 703. The grooved rod 702 and seat post support 703 are coupled together so when the motor 701 spins or rotates the grooved-rod 702 clockwise or counterclockwise, the seat post support 703 raises or lowers depending the direction the grooved-rod spins or rotates. The bicyclist riding the stationary bicycle can continue to pedal while the seat post support 703 goes up or down. He bicyclist does not need to stop peddling or dismount the stationary bicycle to adjust the seat 705 height. To raise or lower the seat 705, the bicyclist presses and holds the up/down button 709 located on the handlebar console 713 to activate the motor 701 which spins or rotates the grooved-rod 702, thereby raising or lowering the seat post support 703 and ultimately the seat 705. When the desired height of the seat 705 is reached, the bicyclist releases the up/down button 709. The Bicyclist may also save pone or more seat heights by pressing the save button 710 and a number on the keypad 712 that will associate with the seat height. If the bicyclist wants to adjust the seat height to a saved height, the bicyclist presses the select button 711 and the number on the keypad 712 associated with the desired saved seat height. Once the buttons have been pressed, the motor 701 is activated which spins or rotates the grooved-rod 702 thereby raising or lowering the seat post support 703 to the desired saved height. The seat post support 703 and grooved-rod 702 may use other coupling or connecting gear mechanisms and the example in this paragraph is to illustrate one coupling mechanism or motorized gear mechanism to be used in the present invention and does not limit the scope of the present invention to this one example. The present invention uses mechanical gear technology, which is common knowledge to those familiar with mechanical gears.

Figure 16:
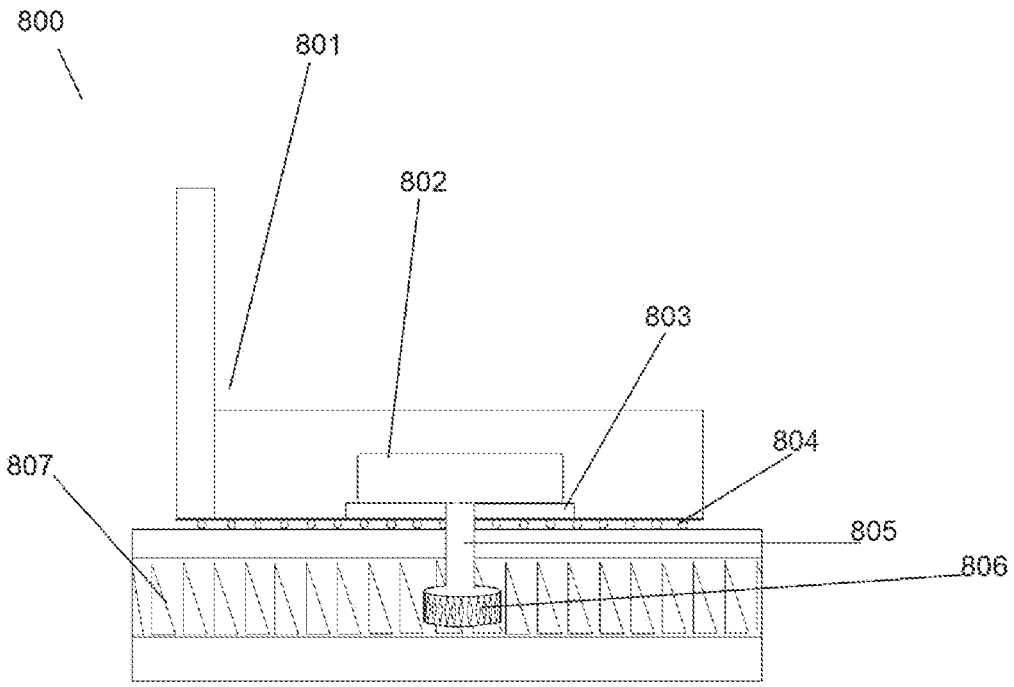
FIG. 16 shows a blow-up cutout side view of a recumbent stationary bicycle seat with a motorized seat the moves the seat forward and back.

FIG. 16 shows a blow-up cutout side view of a motorized seat 800 for a recumbent stationary bicycle. Illustrated is the present invention utilizing a motor 802 contained within the seat 801 that spins or rotates a post 804 that is connected to a grooved wheel or ball 806. The seat 801 of a recumbent stationary bicycle glides or moves on top of a grooved track 807 using ball bearings or small wheels 805. The ball bearings or small wheels 805 are between the seat 801 and the top of the grooved track 807. The bicyclist does not need to dismount the bicycle or stop peddling to adjust the seat position. To adjust the seat position, the bicyclist presses and holds a button located on the handlebars, seat, or console or other location, which activates the motor 802, causing it to spin or rotate the post 804 attached the grooved wheel or ball 806 that is coupled or connected to the grooved track 807 that the seat 801 travels. As described in previous paragraphs and illustrated in previous cutout side view drawings of recumbent stationary bicycles are the locations of the buttons and other redundant information. The present invention uses mechanical gear technology, which is common knowledge to those familiar with mechanical gears.

Referring to ability to create custom programmable saved seat and handlebar positions for saved workout programs is achieved by first moving the seat and/or handlebars to a desired position and saving it within a "workout" program, using the previously mentioned memory saving procedure. The program can be customized to move the positioning of the seat and/or handlebars to saved positions at selected time intervals. The ability to move and save the handlebar positions is done by previously mentioned procedures. The bicyclist may continue to peddle or operate the bicycle while the seat and/or handlebar positions adjust. The bicyclist does not have to dismount bicycle.

The present invention uses worm-gear mechanisms, other mechanical gears, hydraulics, air cylinders, pneumatics, and other pressurized cylinders, which are common knowledge to those familiar with mechanical gears, hydraulics, air cylinders, pneumatics and other pressurized cylinders.

While only selected embodiments have been chosen to illustrate the present invention, it will be apparent to those skilled in the art from this disclosure that various changes and modifications can be made herein without departing from the scope of the invention. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention. There are many styles, shapes and sizes of stationary bicycles, upright, recumbent and others, therefore the illustrated examples of the present invention are used as an example of the numerous uses of the present invention in all models, styles and sizes of stationary bicycles and do not limit the present invention to the scope of the examples, rather illustrate the versatility of the present invention.

What is claimed is:

1. An exercise and rehabilitation bicycle comprising:

an exercise and rehabilitation bicycle frame;

a pedaling mechanism connected to the bicycle frame, the pedaling mechanism configured to be peddled by a user's legs;

a seat post connected to the bicycle frame;

a seat support connected to the seat post;

a seat adjustment mechanism connected to the bottom of the seat post;

a handlebar post connected to the bicycle frame, the handlebar post configured to be in front of an exercise bicycle user while the user is peddling, the handlebar post including:

a handlebar post base connected to the bicycle frame, the handlebar post base proximate to a ground plane;

a handlebar post support connected to the top of the handlebar post base, the handlebar post support configured to extend or contract coaxially with the handlebar post base while the user is peddling; and a handlebar connected to the top of the handlebar post support, the handlebar configured to support a user's posture;

a handlebar height adjustment mechanism comprising:

a handlebar extension mechanism connected to the bottom of the handlebar post support, the handlebar extension mechanism configured to extend the handlebar post support away from the ground plane while the user is peddling; and a handlebar height control button connected to the handlebar extension mechanism; and a handlebar tilt adjustment mechanism comprising:

a handlebar base displacement mechanism connected to the bottom of the handlebar post base, the handlebar base displacement mechanism configured to displace the handlebar post base away from the exercise bicycle user and displace the handlebar post support radially toward the exercise bicycle user while the user is peddling; and a handlebar tilt button connected to the handlebar base displacement mechanism; wherein the handlebar tilt adjustment mechanism further includes a hydraulic or pneumatic mechanism.

2. The seat adjustment mechanism for the exercise bicycle as claimed in claim 1, wherein the seat adjustment mechanism further includes a mechanical gear, wherein the mechanical gear comprises a mechanical worm-gear.

3. The seat adjustment mechanism for the exercise bicycle as claimed in claim 1, wherein the seat adjustment mechanism further includes a hydraulic mechanism, wherein the hydraulic mechanism comprises a hydraulic cylinder.

4. The seat adjustment mechanism for the exercise bicycle as claimed in claim 1, wherein the seat adjustment mechanism further includes a pneumatic mechanism, wherein the pneumatic mechanism comprises a pneumatic cylinder.

5. The handlebar tilt adjustment mechanism for the exercise bicycle as claimed in claim 1, wherein the handlebar tilt adjustment mechanism further comprises a mechanical gear and gear track.

6. The handlebar tilt adjustment mechanism for the exercise bicycle as claimed in claim 1, wherein the hydraulic mechanism comprises a hydraulic cylinder.

7. The handlebar tilt adjustment mechanism for the exercise bicycle as claimed in claim 1, wherein the pneumatic mechanism comprises a pneumatic cylinder.

8. A handlebar position adjustment mechanism for exercise and rehabilitation bicycles, the mechanism comprising:

a handlebar post connected to an exercise bicycle frame and to a pedaling mechanism configured to be peddled by a user's legs, the handlebar post configured to be in front of an exercise bicycle user while the user is peddling, the handlebar post including:

a handlebar post base connected to the bicycle frame, the handlebar post base proximate to a ground plane;

a handlebar post support connected to the top of the handlebar post base, the handlebar post support configured to extend or contract coaxially with the handlebar post base while the user is peddling;

a handlebar connected to the top of the handlebar post support, the handlebar configured to support a user's posture;

a handlebar extension mechanism connected to the bottom of the handlebar post support, the handlebar extension mechanism configured to extend the handlebar post support away from the ground plane while the user is peddling; and a handlebar height control button connected to the handlebar extension mechanism; and a handlebar tilt adjustment mechanism comprising:

a handlebar base displacement mechanism connected to the bottom of the handlebar post base, the handlebar base displacement mechanism configured to displace the handlebar post base away from the exercise bicycle user and displace the handlebar radially toward the exercise bicycle user while the user is peddling; and a handlebar tilt button connected to the handlebar base displacement mechanism; wherein the handlebar tilt adjustment mechanism further includes a hydraulic or pneumatic mechanism.

9. The handlebar position adjustment mechanism for exercise and rehabilitation bicycles as claimed in claim 8, wherein the handlebar tilt adjustment mechanism further includes a mechanical gear, wherein the mechanical gear includes a mechanical worm-gear.

10. The handlebar position adjustment mechanism for exercise and rehabilitation bicycles as claimed in claim 8, wherein the hydraulic mechanism includes a hydraulic cylinder.

11. The handlebar position adjustment mechanism for exercise and rehabilitation bicycles as claimed in claim 8, wherein the pneumatic mechanism includes a pneumatic cylinder.

12. The exercise and rehabilitation bicycle as claimed in claim 1, further including a first motor connected to the seat adjustment mechanism.

13. The exercise and rehabilitation bicycle as claimed in claim 1, further including a second motor connected to the handlebar height adjustment mechanism.

14. The exercise and rehabilitation bicycle as claimed in claim 1, further including a third motor connected to the handlebar tilt adjustment mechanism.

15. The exercise and rehabilitation bicycle as claimed in claim 12, wherein the first motor is further connected to the handlebar height adjustment mechanism and to the handlebar tilt adjustment mechanism.

16. The exercise and rehabilitation bicycle as claimed in claim 15, wherein the exercise and rehabilitation bicycle further includes a programmable adjustment module, the programmable adjustment module configured to cause the first motor to cause the seat adjustment mechanism, the handlebar height adjustment mechanism, or the handlebar tilt adjustment mechanism to adjust to a selected position configuration.

* * * * *